US010517787B1

(12) United States Patent
Hyams

(10) Patent No.: US 10,517,787 B1
(45) Date of Patent: Dec. 31, 2019

(54) STRETCH MACHINE WITH ADJUSTMENT FEATURES

(71) Applicant: Medvibe LLC, Scottsdales, AZ (US)

(72) Inventor: Jonathan Hyams, Scottsdale, AZ (US)

(73) Assignee: Medvibe LLC, Scottsdale, AZ (US)

( * ) Notice: Subject to any disclaimer, the term of this patent is extended or adjusted under 35 U.S.C. 154(b) by 127 days.

(21) Appl. No.: 15/832,474

(22) Filed: Dec. 5, 2017

Related U.S. Application Data

(60) Provisional application No. 62/429,880, filed on Dec. 5, 2016.

(51) Int. Cl.
*A61H 1/02* (2006.01)
*A63B 21/00* (2006.01)
*A63B 23/00* (2006.01)

(52) U.S. Cl.
CPC ..... *A61H 1/0214* (2013.01); *A61H 1/0237* (2013.01); *A61H 1/0274* (2013.01); *A63B 21/4035* (2015.10); *A63B 2023/006* (2013.01)

(58) Field of Classification Search
CPC .. A61H 1/0214; A61H 1/0237; A61H 1/0274; A63B 21/4035; A63B 2023/006
See application file for complete search history.

(56) References Cited

U.S. PATENT DOCUMENTS 4,429,868 A 2/1984 LeBlanc et al.
4,768,775 A * 9/1988 Marshall ..... A63B 22/0076 482/133
5,527,248 A 6/1996 Crivello
6,217,488 B1 4/2001 Bernardson
6,244,992 B1 6/2001 James
6,503,178 B1 1/2003 Gibbons
6,589,141 B1 7/2003 Flaggs
6,626,807 B1 9/2003 Richmond
6,676,578 B2 1/2004 Lindqvist
6,709,368 B1 3/2004 Chue
6,752,745 B1 6/2004 Davis
7,011,612 B2 3/2006 Repking
7,294,099 B2 11/2007 Schenk
7,837,604 B1 * 11/2010 Hsu ..... A63B 22/0056 482/137
7,857,733 B2 12/2010 Tsarkiris
8,118,715 B2 * 2/2012 Greene ..... A63B 21/4029 482/57
8,360,940 B2 1/2013 Kole et al.
8,801,579 B2 8/2014 Beck et al.
9,028,375 B2 * 5/2015 Ho ..... A63B 21/00 482/131

(Continued)

*Primary Examiner* — Joshua Lee
(74) *Attorney, Agent, or Firm* — Invention To Patent Services; Alex Hobson

(57) ABSTRACT

A stretch machine has a seat assembly that is coupled to a seat rail and is adjustable along the seat rail to accommodate people of different sizes. The seat assembly has a knee and a back cushion and can pivot with respect to the seat rail to perform stretching exercises. A person may sit on the back support and extend one or more limbs to the handlebar assembly and then rotate the seat assembly to stretch. A front support extends up to a handlebar assembly that has a front and a back handlebar. A standing stretch board is attached to the front support and can be adjusted along the front support to change the incline angle of the standing stretch board.

18 Claims, 14 Drawing Sheets

(56) References Cited

U.S. PATENT DOCUMENTS

| | | | | |
|---|---|---|---|---|
| 9,028,376 | B2 * | 5/2015 | Ho | A63B 22/205 482/131 |
| 2005/0271453 | A1 | 12/2005 | Haneda | |
| 2006/0160683 | A1 | 7/2006 | Schenk | |
| 2008/0064577 | A1 * | 3/2008 | Pederson | A63B 22/0087 482/140 |
| 2008/0312051 | A1 | 12/2008 | Manyseng | |
| 2010/0234195 | A1 | 9/2010 | Koskela | |
| 2013/0095981 | A1 * | 4/2013 | Chung-Ting | A63B 21/015 482/66 |
| 2014/0100086 | A1 | 4/2014 | Pagliaro | |
| 2014/0100087 | A1 | 4/2014 | Ha | |
| 2014/0187389 | A1 | 7/2014 | Berg | |
| 2014/0194260 | A1 | 7/2014 | Campanaro et al. | |
| 2015/0202484 | A1 * | 7/2015 | Lalaoua | A63B 21/025 482/127 |

* cited by examiner

STRETCH MACHINE WITH ADJUSTMENT FEATURES

CROSS REFERENCE TO RELATED APPLICATIONS

This application claims the benefit of priority to U.S. provisional patent application No. 62/429,880, filed on Dec. 5, 2016; the entirety of which is hereby incorporated by reference herein.

BACKGROUND OF THE INVENTION

Field of the Invention

The present invention relates to stretch machines.

Background

Stretch machines provide people with a means to stretch a wide range of body parts. Stretch machines typically have a handlebar and a pivoting seat. Unfortunately, the pivoting seat assembly is not adjustable to change the distance to the handlebar, thereby making it difficult for some people, such as very tall people, to utilize the stretch machines effectively.

SUMMARY OF THE INVENTION

The invention is directed to a stretch machine comprising an adjustable seat assembly and/or a standing stretch board. An exemplary stretch machine comprises a seat rail having a seat assembly coupled thereto and a front support that extends upward to a handlebar assembly. A person can support themselves on the seat assembly and further secure a body part to the handlebar assembly and stretch. The seat assembly pivots about a seat assembly pivot to enable the person to control the amount of stretch. A person may grab onto the handlebar assembly and while seated and pivot the seat assembly back and away from the handlebar assembly to stretch their back and arms, for example. An exemplary seat assembly comprises a knee cushion and a back cushion. A person may sit on the back cushion and configure their leg with their knee against the knee cushion for stretching. An exemplary stretch machine comprises a seat adjustment feature for adjusting the position of the seat assembly along the seat rail. This enables people of varying heights to configure the machine for optimal comfort and effectiveness. An exemplary stretch machine comprises a standing stretch platform that is coupled to the front support and front handlebars. A standing stretch platform may be adjustable in incline angle along the front support. A plurality of stretch board apertures in the front assembly enable a user to configure the standing stretch platform at a desired incline angle and the front handlebars provide a convenient place to support themselves while stretching on the standing stretch platform.

An exemplary stretch machine comprises a frame having a front base and a back base that supports the stretch machine in an upright orientation. The front and back base may extend substantially perpendicular to the seat rail or length axis of the stretch machine to prevent the stretch machine from tilting while in use. A seat rail may extend along the length axis of the stretch machine from the back base and may couple directly to the front support or may couple with a connection rail that is coupled with the front support. The seat rail may extend substantially horizontally, or within about 10 or 20 degrees of horizontal. The front support and/or the seat or connection rail are coupled with the front base and again the front base may extend perpendicular to the length axis of machine. The front support extends vertically or upward to the handlebar assembly. An exemplary handlebar assembly has a front handlebar and a back handlebar. The front handlebar is configured for supporting a person while using the stretching platform and the back handlebar is configured for use while on the seat assembly or when located back of the handlebar assembly. The front handlebar assembly may be configured forward of the front support while the back handlebar may be configured back of the front support.

In an exemplary embodiment, the seat assembly is configured to be adjusted in location along the seat rail by a seat adjustment feature that allows the seat to be retained in different locations along the seat rail. For example, the seat rail may comprise seat adjustment recesses for receiving a rail retainer. In an exemplary embodiment, a rail retainer extends into the seat adjustment recess to secure the seat assembly in position along the seat rail. A rail retainer may be spring loaded to prevent the seat assembly from becoming dislodged while in use and the rail retainer may be rotated or otherwise manipulated to lock the rail retainer in position. A rail bracket may slide along the seat rail and be couple with the seat assembly that rotates about a seat assembly pivot. A rail bracket may comprise a left and right pedal that extend out from rail bracket. The left and right pedal may be used to support a use of the stretch machine by placement of their foot thereon. A rail bracket may comprise a rail aperture for alignment with seat adjustment recess in the seat rail. The rail retainer may extend through the rail aperture and into the seat adjustment recess to retain the seat assembly in a desired location. A seat rail may comprise any suitable number of seat adjustment recesses including, but not limited to two or more, three or more, five or more, ten or more and any number between and including the numbers provided. The rail bracket may be configured to be adjusted and retained in position over an adjustable length that is at least about four inches, at least about six inches, at least about eight inches, at least about ten inches and any range between and including the adjustable lengths provided. An adjustment in the rail bracket position along the seat rail changes the offset distance from the front of the knee cushion to the back handlebar, when the seat assembly is in a down and resting position. The offset distance may be adjusted for a person's height. The seat adjustment feature described is exemplary and other configurations for retaining the seat in adjustable positions may be utilized.

An exemplary seat assembly is coupled to the rail bracket about a seat assembly pivot. A seat retainer may extend through a seat assembly aperture in the rail bracket and then through the seat assembly pivot, such as a cylinder to enable the seat assembly to pivot about the rail bracket. The seat assembly has a knee cushion the is configured horizontally when the seat assembly is rotated down in a resting position and a back cushion that extend upward from the seat rail when in a down position. A knee cushion base supports the knee cushion and a back cushion bracket and/or back support retain the back cushion in position. A user may sit on the back cushion and pivot the seat assembly back from the front support to perform any number of stretches, as described herein and shown in the figures.

An exemplary stretch machine comprises a standing stretch platform that is configured to be adjusted in incline angle. An exemplary standing stretch platform has a connected end that is coupled with the front support and an extend end that extends forward from the front support. The connected end of the standing stretch platform may be coupled to the front support at different heights to change the incline angle. The front support may have a plurality of stretch board apertures for receiving a stretch board retainer, such as a pin, that is inserted to secure the standing stretch platform in a desired incline angle. The front support may have any number of stretch board apertures including, two or more, three or more, five or more, eight or more, or ten or more. The incline angle may be adjustable from substantially zero degree, or flat to about 15 degrees or more, about 30 degrees or more, about 45 degrees or more, about 60 degrees or more and any range between and including the incline angles provided. A standing stretch board may comprise a heal stop configured on the extended end to support a person's heal while stretching on the standing stretch board assembly.

An exemplary handlebar assembly has a front and back handlebar. The front and/or back handlebar may be a continuous bar or may comprise a separation to create a left and right handlebar. A left and right handlebar may be used when switching which side of the body or body part is being stretched.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
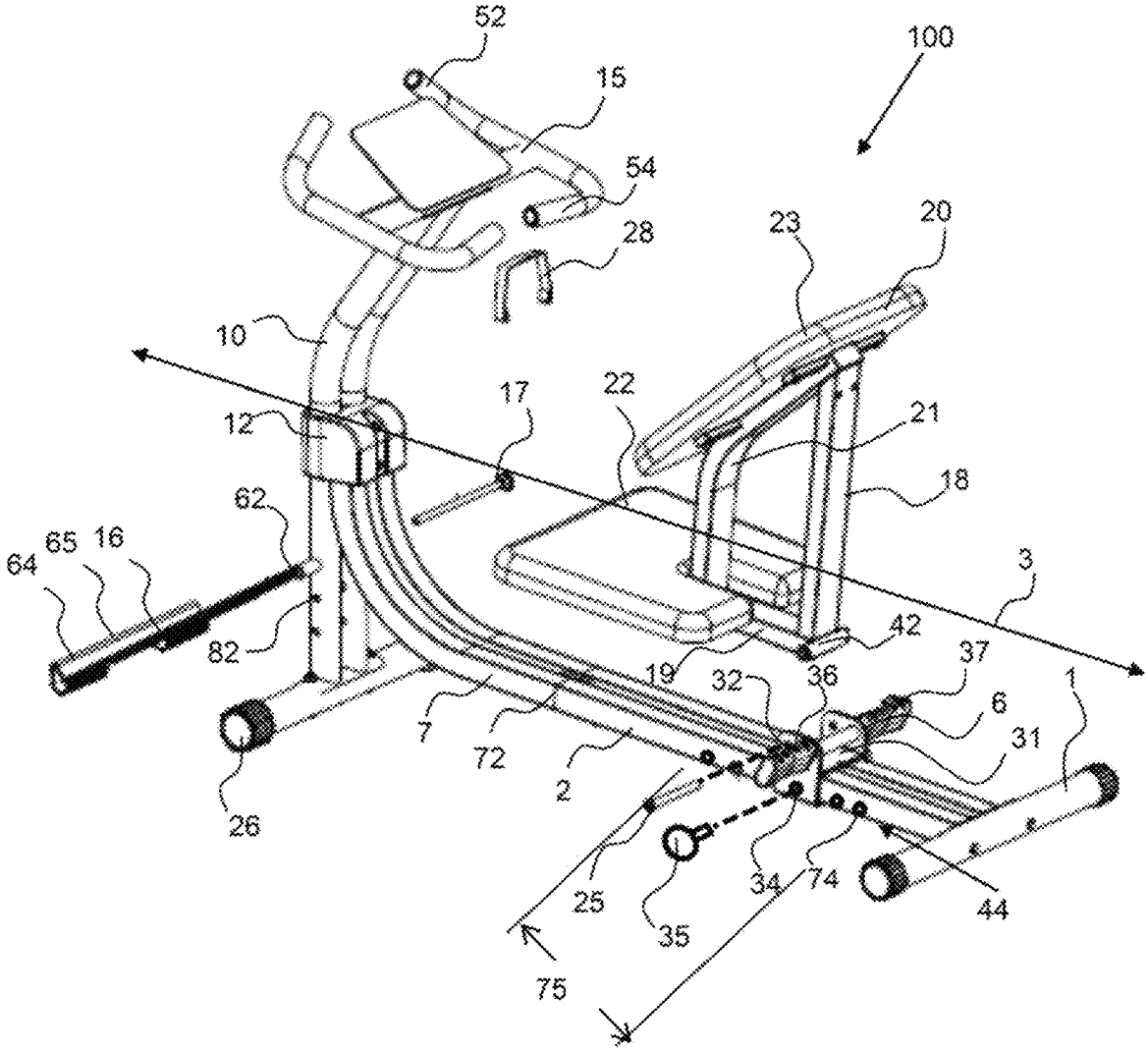
FIG. 1 shows a perspective view of an exemplary stretch machine having the seat assembly and detached from the rail bracket and the standing stretch board detached from the front support.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

In cases where the present specification and a document incorporated by reference include conflicting and/or inconsistent disclosure, the present specification shall control.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications and improvements are within the scope of the present invention.

As shown in FIG. 1, an exemplary stretch machine 100 has the seat assembly 20 detached from the rail bracket 31 and the standing stretch board 16 detached from the front support 10. The seat assembly comprises a knee cushion 22 supported by a knee cushion base 19 and a back cushion 23 supported by a back cushion bracket 21. A back support secures and retains the extended end of the back cushion bracket to the knee cushion base. A seat assembly pivot 42 is configured to receive the seat retainer 25 and allow the seat assembly to rotate about the seat assembly pivot, with respect to the rail bracket 31. The seat retainer 25 is configured to extend through the seat assembly aperture 32 in the rail bracket and then into the seat assembly pivot. The left pedal 36 and right pedal 37 are coupled to the rail bracket 31 by a pedal assembly 6, or a support that extends out from the rail assembly. These pedals can be used to support a person while doing certain stretch exercises.

Figure 2:
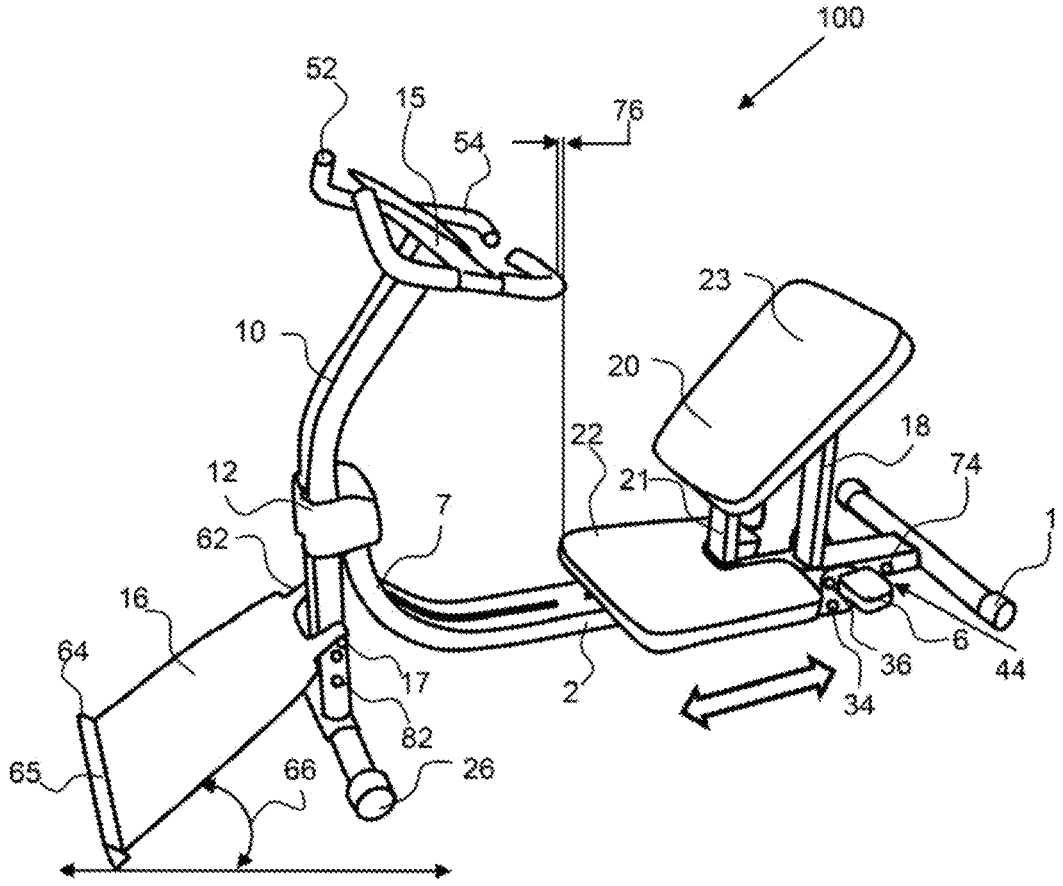
FIG. 2 shows a perspective view of an exemplary stretch machine having the seat assembly attached and in a forward retained position and the standing stretch board retained in a most upward position.

As shown in FIG. 1, the exemplary stretch machine 10 comprises a seat adjustment feature 44 for adjusting the position of the seat with respect to the handlebar assembly, or along the length of the seat rail. The rail bracket is configured to be slidably engaged with the seat rail 2. The rail bracket can be retained to the seat rail in a secure position defined by the seat adjustment recesses 74, configured along the seat rail. A rail retainer 35 is configured to extend through the rail aperture 34 in the rail bracket 31 and then engage with the seat adjustment recesses 74 to secure the rail bracket in position along the seat rail 2. The seat rail has a plurality of seat adjustment recesses to allow adjustment of an offset distance 76, as shown in FIG. 2, or a distance from the handlebar assembly to the seat assembly.

The seat assembly can be adjusted over an adjustable length 75 along the seat rail 2, or along the length axis 3 of the stretch machine.

As shown in FIG. 1, the exemplary seat rail extends from the back base 1 towards the front of the stretch machine. The seat rail may be connected with a connector rail 7 by a rail connector 72. The connector rail is secured to the front support 10 by a connector 12. The seat rail may extend to and couple directly with the front support however. A connector rail may be used for packaging purposed to reduce the length of the package for shipment. The front support extends upward from the front base 26 to a handlebar assembly 15. The handlebar assembly has a front handlebar 52 and a back handlebar 54. The front handlebar is configured proximal to the front of the machine while the back handlebar is configured more proximal to the seat assembly, or the back of the stretch machine along the length axis. The front handlebar 52 may be used for support while using the standing stretch board 16 and the back handlebar may be used while utilizing the rotating seat assembly 20. The front handlebar may be forward the front support 10 while the back handlebar may be configured back from the front support. The front and back handlebars may have a left and a right portion as shown or alternatively may comprise a single bar that extends across the length axis of the machine from a left side to a right side.

As shown in FIG. 1, the exemplary standing stretch board 16 has an attached end 62 and an extended end 64, that is resting on the floor. The front support 10 has a plurality of stretch board apertures 82 for retaining the stretch board at different incline angles. A stretch board pin 17 is configured to extend through the attached end of the stretch board and also through a stretch board aperture in the front support to secure the stretch board at an incline angle.

As shown in FIG. 2, an exemplary stretch machine 10 has the seat assembly 20 attached and in a forward retained position and the standing stretch board 16 retained in a most upward position or at the highest incline angle. The attached end 62 of the standing stretch board is coupled to the uppermost stretch board aperture 82 in the front support 10. The stretch board pin 17 is retaining the standing stretch board as an incline angle 66. The extended end 64 of the standing stretch board has a heal stop 65 for retaining a person's heal while performing standing stretches. The seat assembly is in a forward position that produces an offset distance 76 that is reduced from a more back position.

Figure 3:
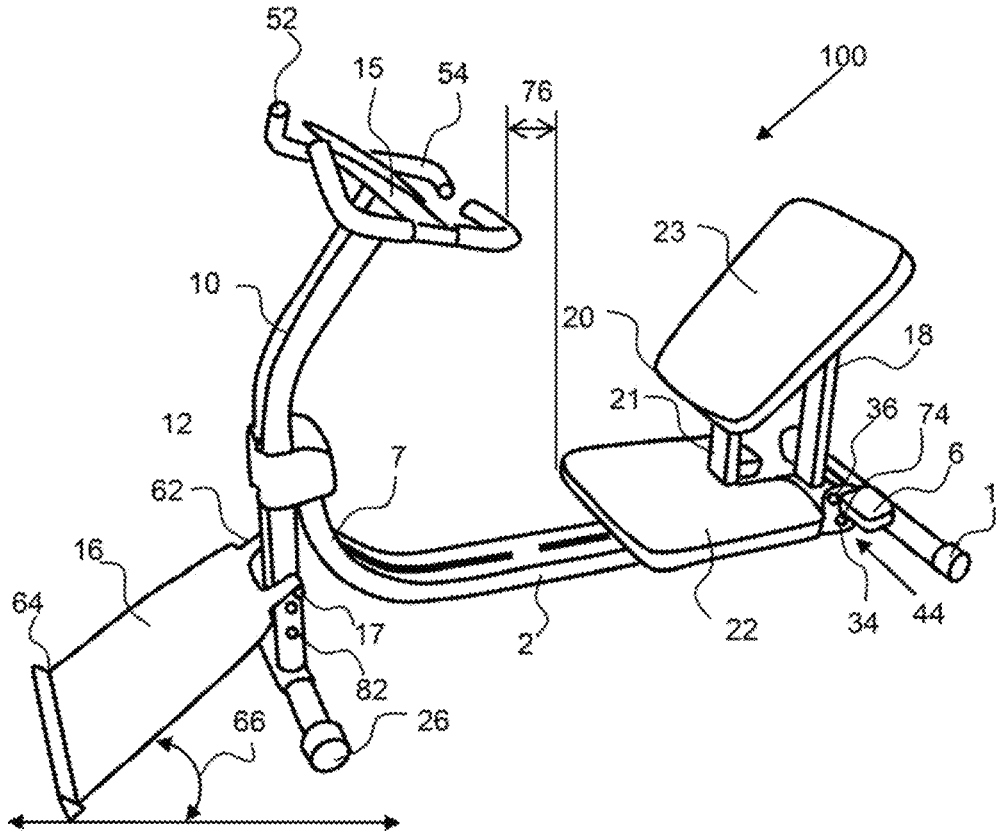
FIG. 3 shows a perspective view of an exemplary stretch machine having the seat assembly attached and in a back retained position.

As shown in FIG. 3, an exemplary stretch machine 100 has the seat assembly 20 attached and in a back retained position. The offset distance 76 is larger than the offset distance shown in FIG. 2.

Figure 4:
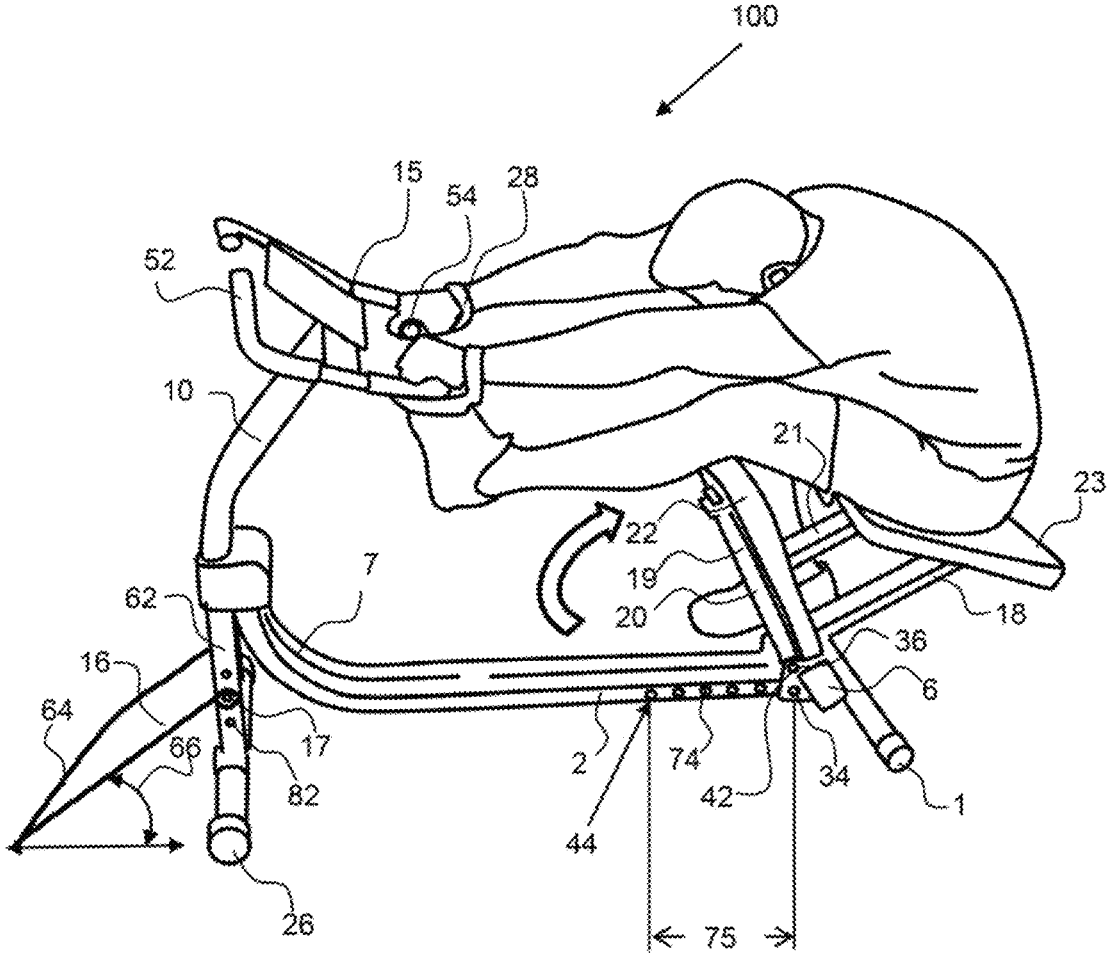
FIG. 4 shows a perspective view of a person utilizing an exemplary stretch machine having the seat assembly attached and in a back retained position and the seat assembly pivoting about the seat assembly pivot.

As shown in FIG. 4, a person is utilizing an exemplary stretch machine 100 having the seat assembly attached and in a back retained position and the seat assembly 20 pivoting about the seat assembly pivot 42. The person has their right foot on the right pedal and their left leg extended to the handlebar assembly 15 to stretch their hamstring. As shown, there are six seat adjustment recesses 74 configured along the seat rail 2. The person is holding onto the back handlebar 54 and the strap 28 is configured around their wrists.

Figure 5:
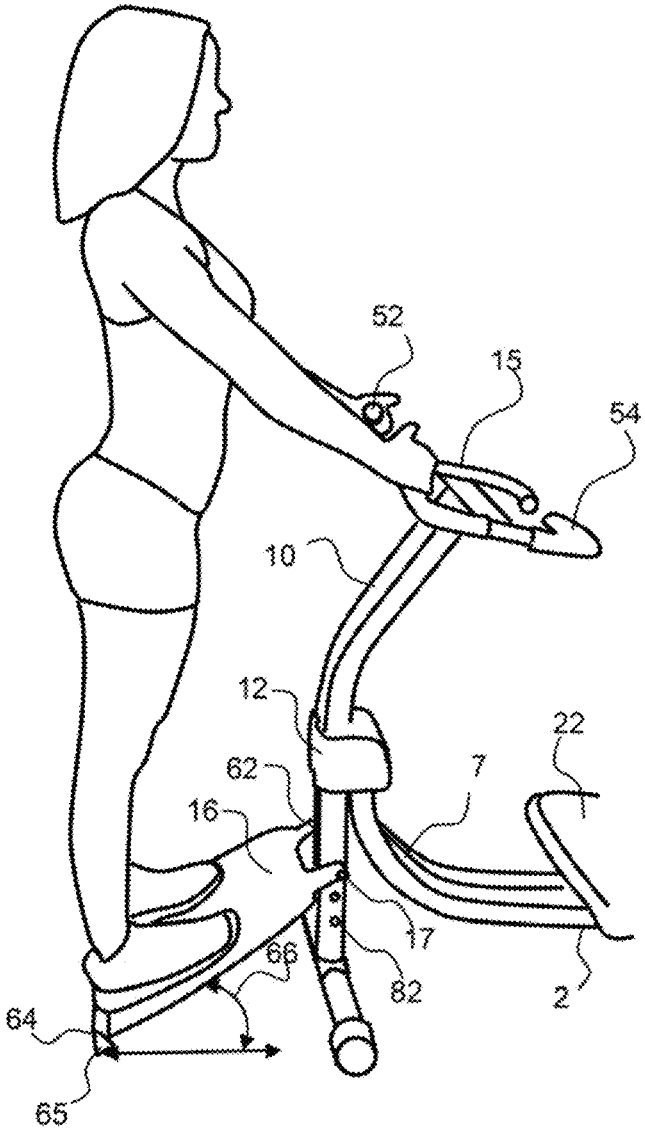
FIG. 5 shows a perspective view of a person utilizing an exemplary stretch machine by standing on the standing stretch board in an up position.

As shown in FIG. 5, a person is utilizing an exemplary stretch machine 100 by standing on the standing stretch board 16 in an up position. The person is holding onto the front handlebars 52 of the handlebar assembly 15.

Figure 6:
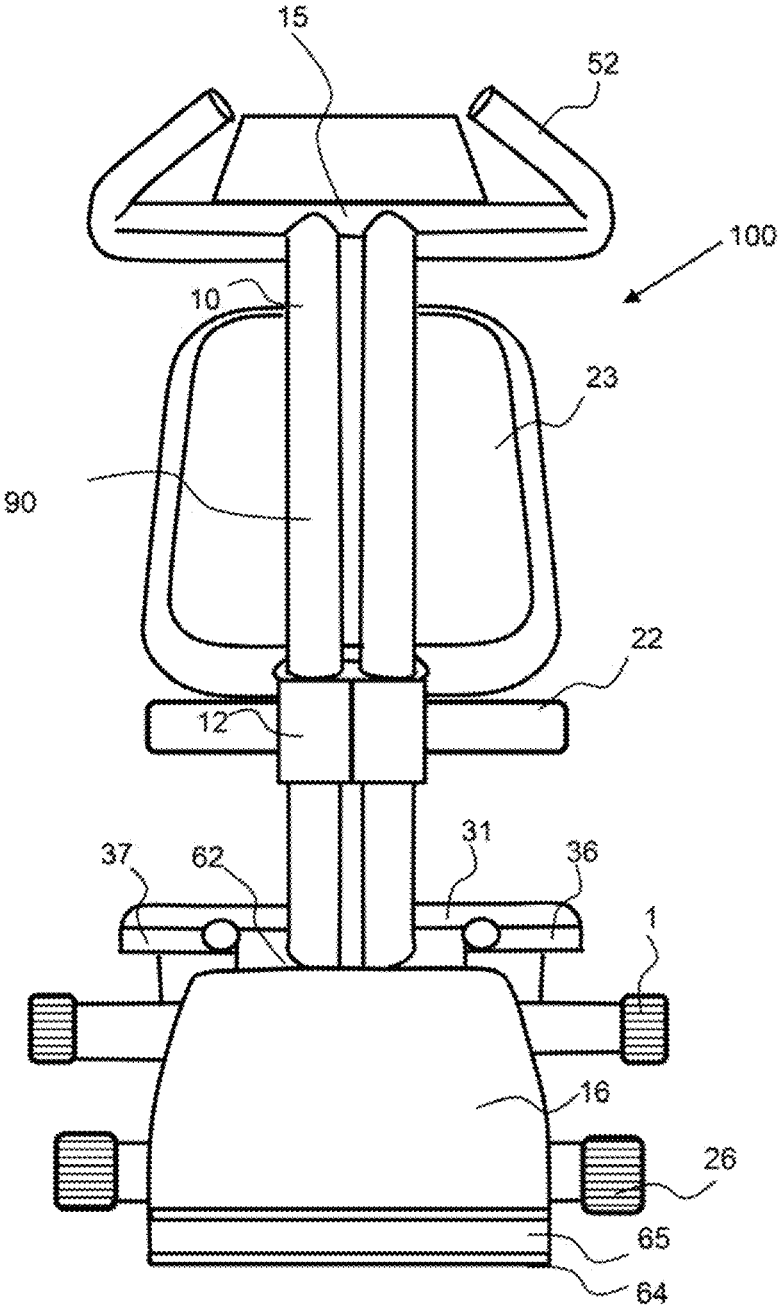
FIG. 6 shows a front view an exemplary stretch machine.

As shown in FIG. 6, an exemplary stretch machine 10 has a standing stretch platform 16 that extends from the front 90 of the machine and is attached to the front support 10 that extends up to the handlebar assembly 15. The front handlebar 52 has a left and a right portion for holding onto when performing a standing stretch.

Figure 7:
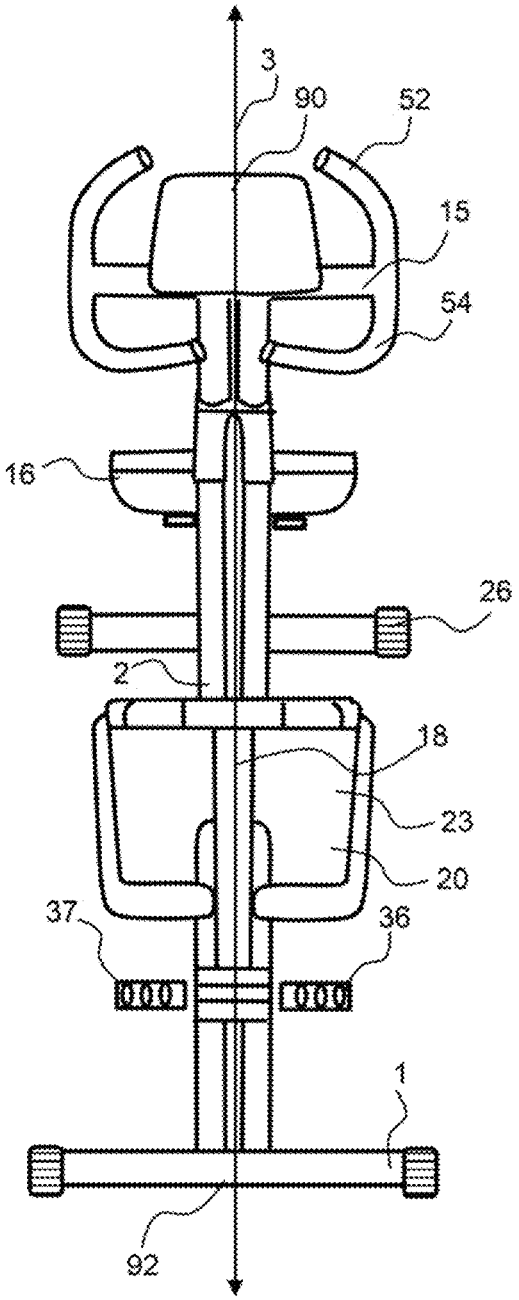
FIG. 7 shows a top view an exemplary stretch machine.

As shown in FIG. 7, an exemplary stretch machine 10 has a front 90 and a back and a length axis 3 from the front to the back. The length axis is parallel with the length of the seat rail 2. The handlebar assembly 15 is in the front of the machine and the seat assembly 20 is configured back from the handlebar assembly.

Figure 8:
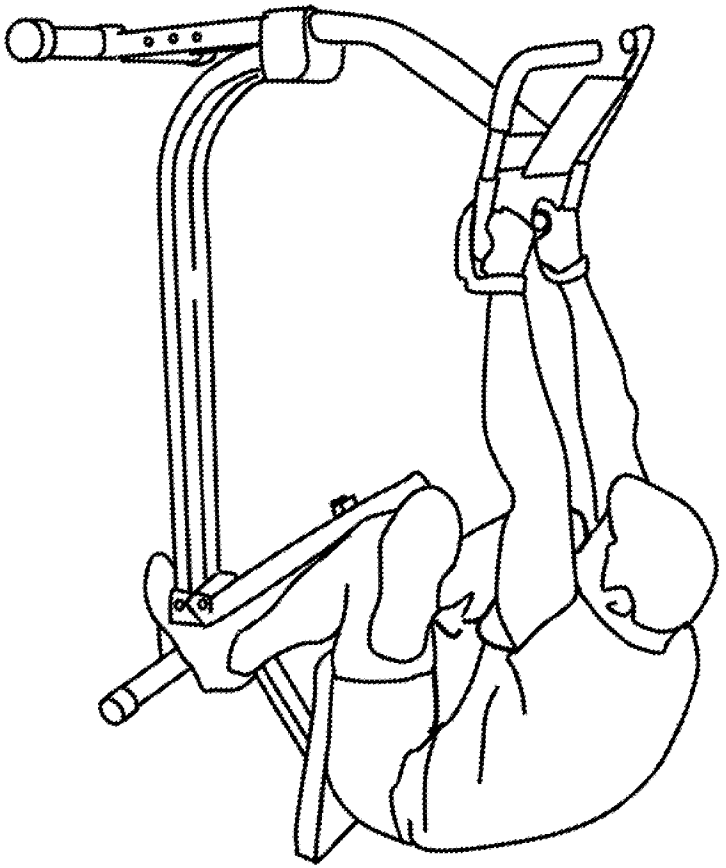
FIGS. 8 through 12 show photographs of people performing various stretching exercises on the exemplary stretch machine as described herein.
Figure 9:
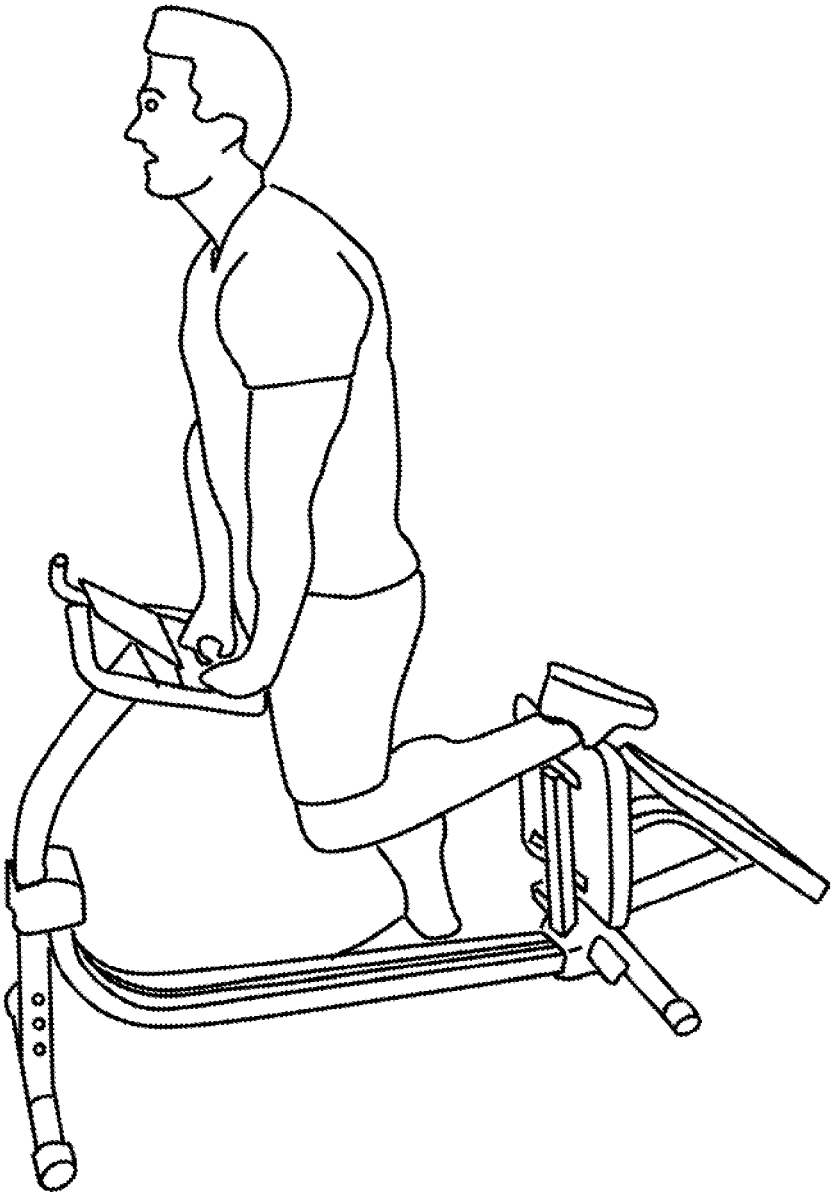
Figure 10:
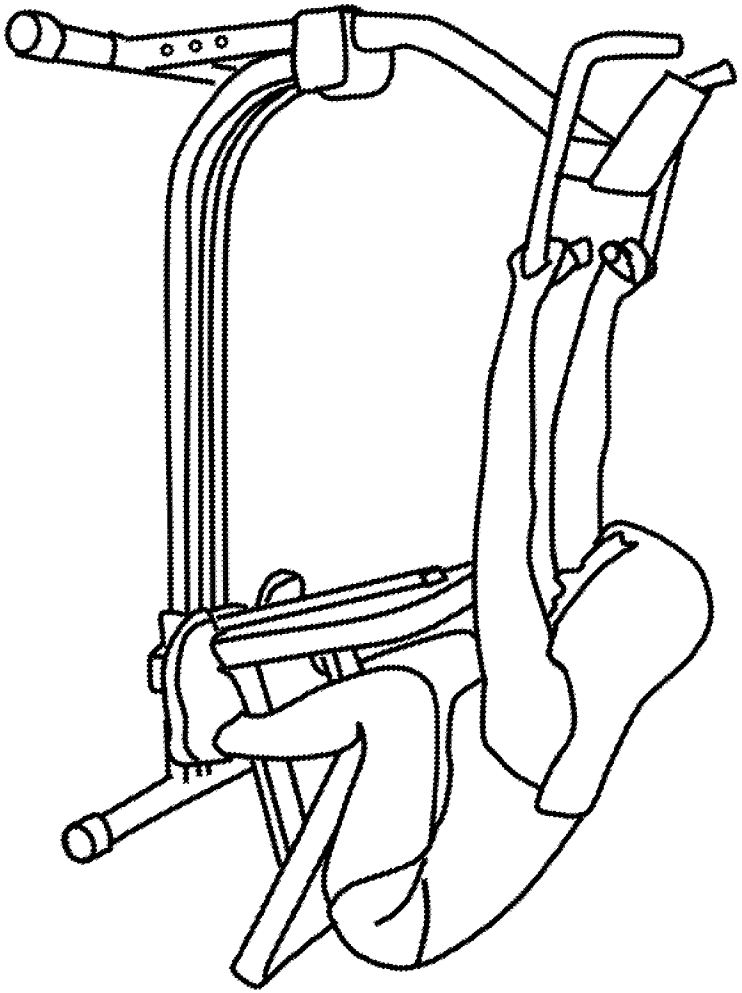
Figure 11:
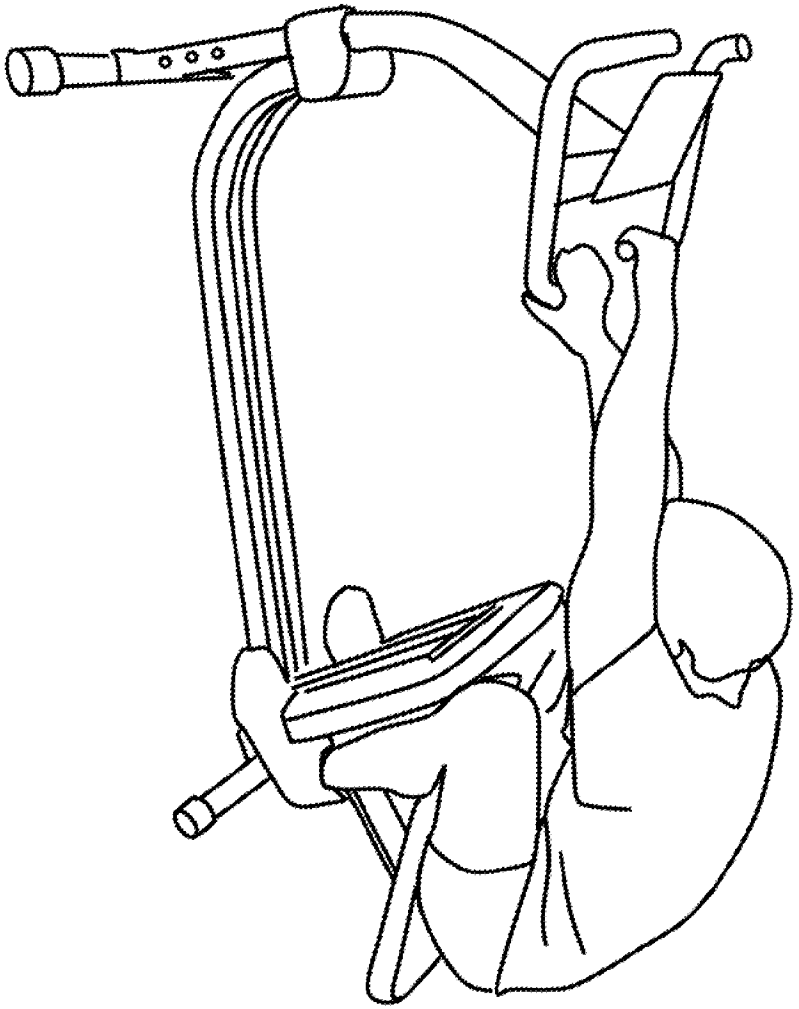
Figure 12:
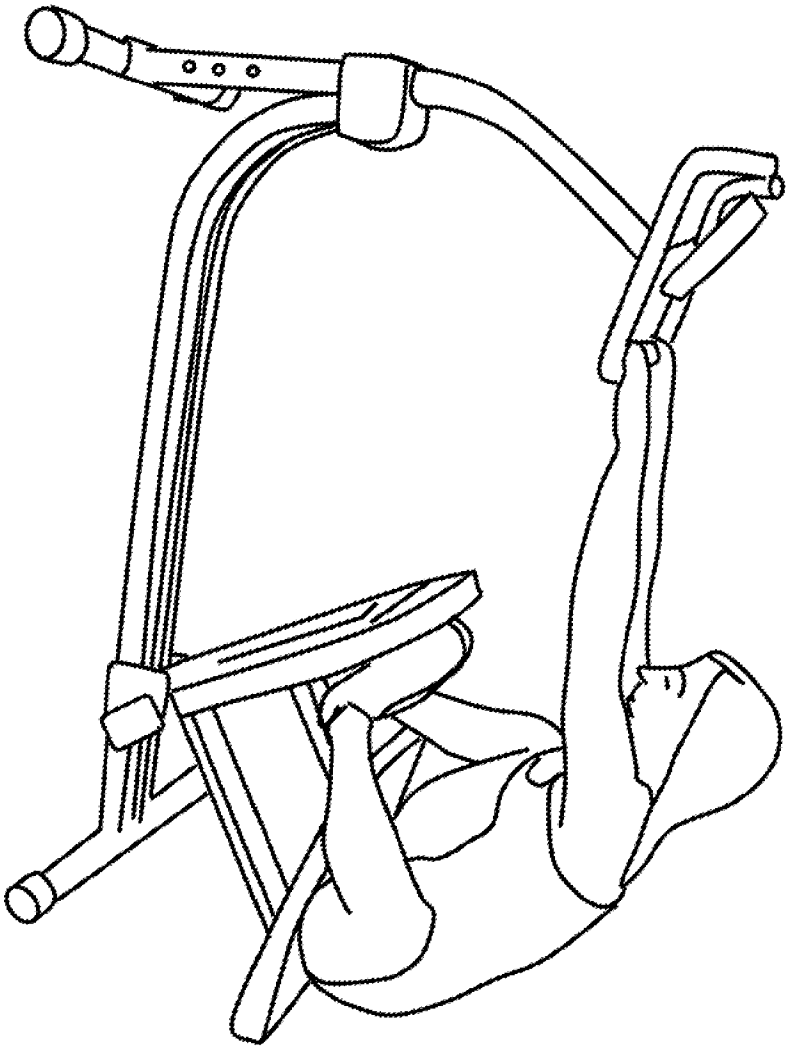
Figure 13:
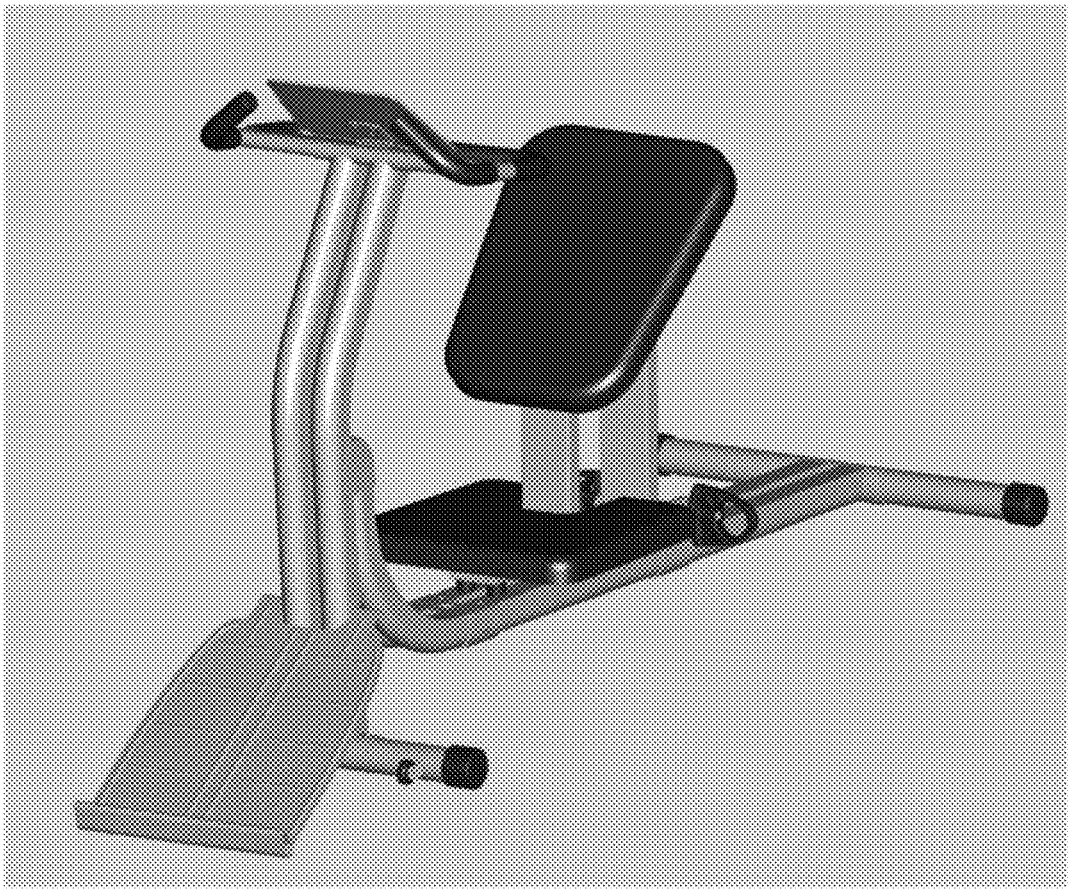
FIG. 13 shows a perspective view of an exemplary stretch machine as described herein.

FIGS. 8 through 12 show photographs of people performing various stretching exercises on the exemplary stretch machine as described herein. In FIG. 8, the person is holding onto the back handlebar and tilting the seat assembly back about the pivot. In FIG. 9, the person is standing on one leg, holding onto the back handlebars and has their foot on the front edge of the knee cushion with the seat assembly rotated back. In FIGS. 10 and 11, the person is holding onto the back handlebars and tilting the seat assembly back about the pivot while sitting on the back cushion with their feet on the pedals. In FIG. 12, the person is holding onto the back handlebars and tilting the seat assembly back about the pivot while sitting on the back cushion with their feet on the knee cushion As shown in FIG. 13, the standing stretch platform extends from the front support at an incline angle. The standings stretch platform has some texture on the front engagement face, to prevent slipping in use.

Figure 14:
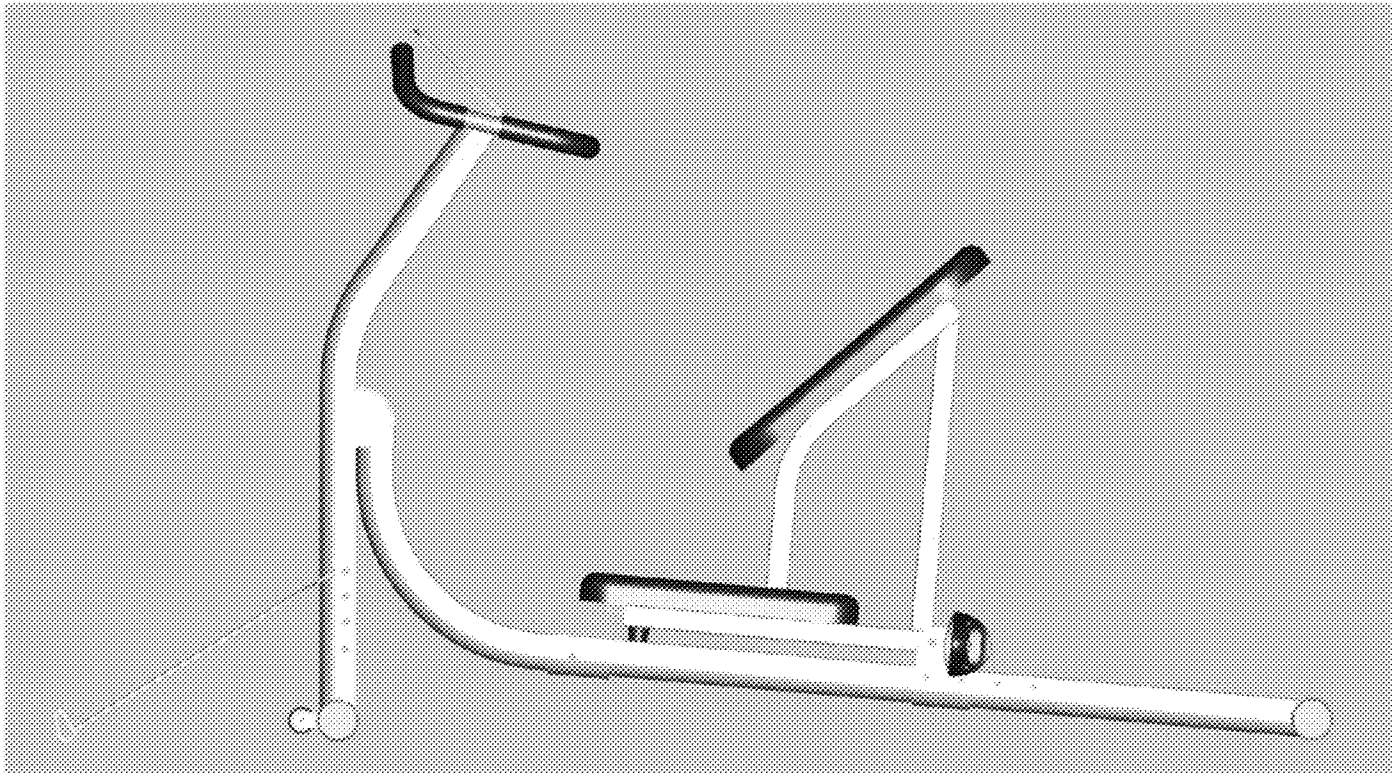
FIG. 14 shows a side vie of an exemplary stretch machine as described herein.

FIG. 14 shows a side vie of an exemplary stretch machine as described herein.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A stretch machine comprising:

a) a front base;

b) a back base;

c) a seat rail that is coupled with the back base and extending toward the front base and comprising:

i) a plurality of seat adjustment recesses;

d) a handlebar assembly comprising:

i) a handlebar;

e) a front support that extends up to said handlebar assembly;

f) a seat assembly comprising:

i) a knee cushion supported by a knee cushion base;

ii) a back cushion supported by a back cushion bracket; and iii) a seat assembly pivot;

g) a rail bracket that is slidably engaged with the seat rail and comprising:

i) a left pedal and a right pedal;

ii) a seat assembly aperture for receiving a seat retainer; wherein the seat retainer extends through the seat assembly aperture of the rail bracket and into the seat assembly pivot to enable the seat assembly to rotate about the seat assembly pivot;

iii) a rail aperture for receiving a rail retainer; wherein the rail retainer extends through the rail aperture of the rail bracket and into one of the plurality of seat adjustment recesses to retain the rail bracket and the seat assembly attached thereto, in a set position; and wherein an offset distance of the seat assembly to the handlebar can be adjusted.

2. The stretch machine of claim 1, wherein the seat assembly pivot comprises an aperture for receiving the seat retainer.

3. The stretch machine of claim 1, wherein the seat adjustment recesses each comprises an aperture in the seat rail for receiving the rail retainer.

4. The stretch machine of claim 1, wherein the seat adjustment recesses each comprises female threads and wherein the rail retainer comprises male threads for coupling with the female threads of the respective seat adjustment recess.

5. The stretch machine of claim 1, further comprising at least three seat adjustment recesses.

6. The stretch machine of claim 1, wherein a most proximal seat adjustment recess relative to the front support is at least 10 cm closer to the front support than a most distal seat adjustment recess.

7. The stretch machine of claim 1, wherein a most proximal seat adjustment recess relative to the front support is at least 20 cm closer to the front support than a most distal seat adjustment recess.

8. The stretch machine of claim 1, further comprising a standing stretch board.

9. The stretch machine of claim 8, wherein the standing stretch board is detachably attachable to the stretch machine.

10. The stretch machine of claim 8, wherein the standing stretch board extends from a front of the stretch machine and wherein the handlebar assembly comprises a front handlebar configured proximal to the standing stretch board and a back handlebar configured more proximal to the seat assembly than the front handlebar.

11. The stretch machine of claim 10, wherein the front support comprises a plurality of stretch board apertures and wherein the standing stretch board comprises an attachable end and an extended end, and wherein the attachable end can be attached to any of the plurality of stretch board apertures to change an incline angle of the standing stretch board.

12. The stretch machine of claim 11, wherein the attachable end of the standing stretch board comprises an aperture for receiving a stretch board retainer that extends through said aperture in the attachable end and into one of the plurality of stretch board apertures to retain the stretch board on the stretch machine.

13. The stretch machine of claim 9, wherein the standing stretch board extends from a front of the stretch machine and wherein the handlebar assembly comprises a front handlebar configured proximal to the standing stretch board and a back handlebar configured more proximal to the seat assembly than the front handlebar.

14. The stretch machine of claim 13, wherein the front support comprises a plurality of stretch board apertures and wherein the standing stretch board comprises an attachable end and an extended end, and wherein the attachable end can be attached to any of the plurality of stretch board apertures to change an incline angle of the standing stretch board.

15. The stretch machine of claim 14, wherein the attachable end of the standing stretch board comprises an aperture for receiving a stretch board retainer that extends through said aperture in the attachable end and into one of the plurality of stretch board apertures to retain the stretch board on the stretch machine.

16. A method of stretching comprising the steps of:

a) providing a stretch machine comprising:
  i) a front base;
  ii) a back base;
  iii) a seat rail that extends substantially horizontally from said back base toward said front base and comprising:
    a plurality of seat adjustment recesses;
  iv) a handlebar assembly comprising:
    a handlebar;
  v) a front support that extends up to said handlebar assembly;
  vi) a seat assembly comprising:
    a knee cushion supported by a knee cushion base;
    a back cushion supported by a back cushion bracket; and
    a seat assembly pivot;
  vii) a rail bracket that is slidably engaged with the seat rail and comprising:
    a left pedal and a right pedal;
    a seat assembly aperture for receiving a seat retainer;
  wherein the seat retainer extends through the seat assembly aperture of the rail bracket and into the seat assembly pivot to enable the seat assembly to rotate about the seat assembly pivot;
    a rail aperture for receiving a rail retainer;
  wherein the rail retainer extends through the rail aperture of the rail bracket and into one of the plurality of seat adjustment recesses to retain the rail bracket and the seat assembly attached thereto, in a set position; and
  wherein an offset distance of the seat assembly to the handlebar can be adjusted;

b) removing the rail retainer from the respective seat adjustment recess in the seat rail to free the rail bracket to move along the seat rail;

c) moving the rail bracket and seat assembly attached thereto to a new location along the seat rail;

d) inserting the rail retainer into the respective seat adjustment recess of the new location to retain the rail bracket and seat assembly attached thereto in a new position and changing said offset distance; and e) performing a stretch exercise on the stretch machine.

17. A method of stretching comprising the steps of:

a) providing a stretch machine comprising:
  i) a front base;
  ii) a back base;
  iii) a seat rail that is coupled with the back base and extending toward the front base and comprising:
    a plurality of seat adjustment recesses;
  iv) a handlebar assembly comprising:
    a handlebar;
  v) a front support that extends up to said handlebar assembly;
  vi) a seat assembly comprising:
    a knee cushion supported by a knee cushion base;
    a back cushion supported by a back cushion bracket; and
    a seat assembly pivot;
  vii) a rail bracket that is slidably coupled with the seat rail and comprising:
    a left and a right pedal;
    a seat assembly aperture for receiving a seat retainer;
  wherein the seat retainer extends through the seat assembly aperture of the rail bracket and into the seat assembly pivot to enable the seat assembly to rotate about the seat assembly pivot;
    a rail aperture for receiving a rail retainer;
  wherein the rail retainer extends through the rail aperture of the rail bracket and into one of the plurality of seat adjustment recesses to retain the rail bracket and the seat assembly attached thereto, in a set position; and wherein an offset distance of the seat assembly to the handlebar can be adjusted;

viii) a standing stretch board;

wherein the standing stretch board is detachably attachable to the stretch machine;

wherein the standing stretch board extends from a front of the stretch machine and wherein the handlebar assembly comprises a front handlebar configured proximal to the standing stretch board and a back handlebar configured more proximal to the seat assembly than the front handlebar;

wherein the front support comprises a plurality of stretch board apertures and wherein the standing stretch board comprises an attachable end and an extended end, and wherein the attachable end can be attached to any of the plurality of stretch board apertures to change an incline angle of the standing stretch board;

b) disengaging the attachable end of the standing stretch board from a first aperture of the plurality of stretch board apertures;

c) attaching the attachable end of the standing stretch board to a second of the plurality of stretch board apertures that is different that the first aperture to change the incline angle of the standing stretch board;

d) performing a standing stretch on the standing stretch board while holding onto the front handlebar.

18. The method of stretching of claim 17, wherein the attachable end of the standing stretch board comprises an aperture for receiving a stretch board retainer that extends through said aperture in the attachable end and into one of the plurality of stretch board apertures to retain the stretch board on the stretch machine.

* * * * *